US008820769B2

(12) United States Patent
Green

(10) Patent No.: US 8,820,769 B2
(45) Date of Patent: Sep. 2, 2014

(54) COLLAPSIBLE SKI

(76) Inventor: Paul Clifford Green, Tamworth (GB)

( * ) Notice: Subject to any disclaimer, the term of this patent is extended or adjusted under 35 U.S.C. 154(b) by 331 days.

(21) Appl. No.: 13/138,621

(22) PCT Filed: Mar. 27, 2009

(86) PCT No.: PCT/GB2009/000809

§ 371 (c)(1),
(2), (4) Date: Sep. 12, 2011

(87) PCT Pub. No.: WO2010/109157

PCT Pub. Date: Sep. 30, 2010

(65) Prior Publication Data

US 2012/0025508 A1 Feb. 2, 2012

(51) Int. Cl.
*A63C 5/02* (2006.01)

(52) U.S. Cl.
CPC ..... *A63C 5/02* (2013.01)
USPC ..... 280/603

(58) Field of Classification Search
USPC ..... 280/603
See application file for complete search history.

(56) References Cited

U.S. PATENT DOCUMENTS

| | | | | | |
|---|---|---|---|---|---|
| 2,387,061 | A | * | 10/1945 | Erickson | 280/603 |
| 2,450,538 | A | * | 10/1948 | Beaudin | 280/603 |
| 3,104,888 | A | * | 9/1963 | Day et al. | 280/603 |
| 3,596,918 | A | * | 8/1971 | Masuda | 280/603 |
| 3,689,093 | A | * | 9/1972 | Meland et al. | 280/603 |
| 3,797,838 | A | | 3/1974 | Shurgot et al. | |
| 3,834,722 | A | * | 9/1974 | Rainer | 280/603 |
| 4,125,273 | A | * | 11/1978 | Rothmayer | 280/603 |
| 4,155,568 | A | * | 5/1979 | Galich | 280/603 |
| 4,358,130 | A | | 11/1982 | Adams | |
| 4,405,150 | A | * | 9/1983 | Esper | 280/603 |
| 4,458,912 | A | * | 7/1984 | Bertonneau | 280/603 |
| 4,530,511 | A | * | 7/1985 | Brandt, III | 280/603 |
| 4,593,926 | A | * | 6/1986 | Pergola | 280/603 |
| 4,645,228 | A | * | 2/1987 | Bertonneau | 280/603 |
| 4,780,929 | A | * | 11/1988 | Burns et al. | 16/349 |
| 4,844,499 | A | * | 7/1989 | Baumann | 280/603 |
| 5,020,821 | A | | 6/1991 | Leroy | |
| 5,083,809 | A | * | 1/1992 | Stampacchia et al. | 280/603 |
| 6,926,301 | B2 | * | 8/2005 | Emanuele et al. | 280/603 |
| 2009/0256332 | A1 | * | 10/2009 | Ekberg | 280/603 |

FOREIGN PATENT DOCUMENTS

| | | | |
|---|---|---|---|
| DE | 87 10 506 | U1 | 10/1987 |
| DE | 195 42 965 | A1 | 5/1997 |
| DE | 196 21 756 | A1 | 12/1997 |
| DE | 20 2006 007755 | U1 | 7/2006 |
| DE | 20 2007 006566 | U1 | 9/2007 |
| FR | 2 692 802 | A1 | 12/1993 |
| WO | WO 85/01883 | A1 | 5/1985 |

* cited by examiner

*Primary Examiner* — Katy M Ebner

(57) ABSTRACT

A ski comprising a front runner (1), a centre runner (2) and a rear runner (3); the runners (1, 2, 3) connectable together to form a longitudinal running surface, the centre runner further comprising a locking mechanism (4) operable to urge the front and rear runners into engagement with the centre runner. Part (5, 7) of the locking mechanism is concealed within the body of the ski and the remaining part (12, 13) is positioned in-between the ski boot (16) bindings so that when the ski boot is clamped into the bindings it forms a protective canopy over the locking mechanism and the assembly takes on the appearance of a one piece ski When the ski is dismantled it can be carried in a case compatible with automated luggage handling systems and inside automobiles without the need for a roof rack.

14 Claims, 7 Drawing Sheets

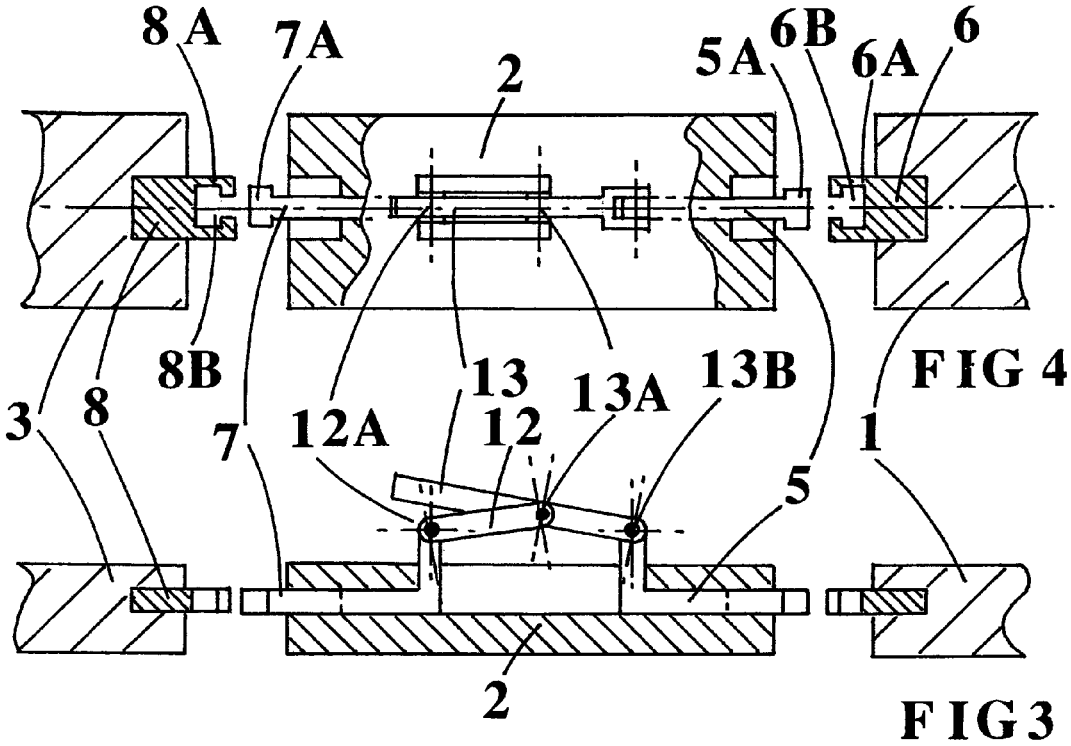
FIG 4
FIG 3
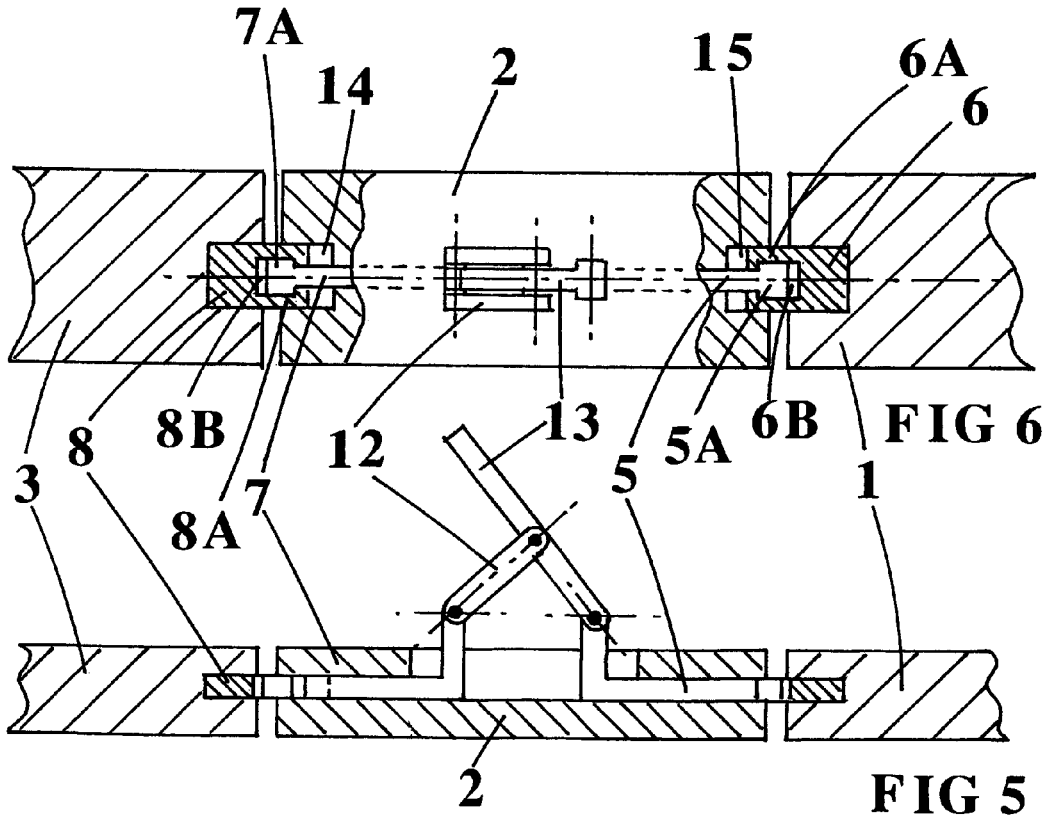
FIG 6
FIG 5

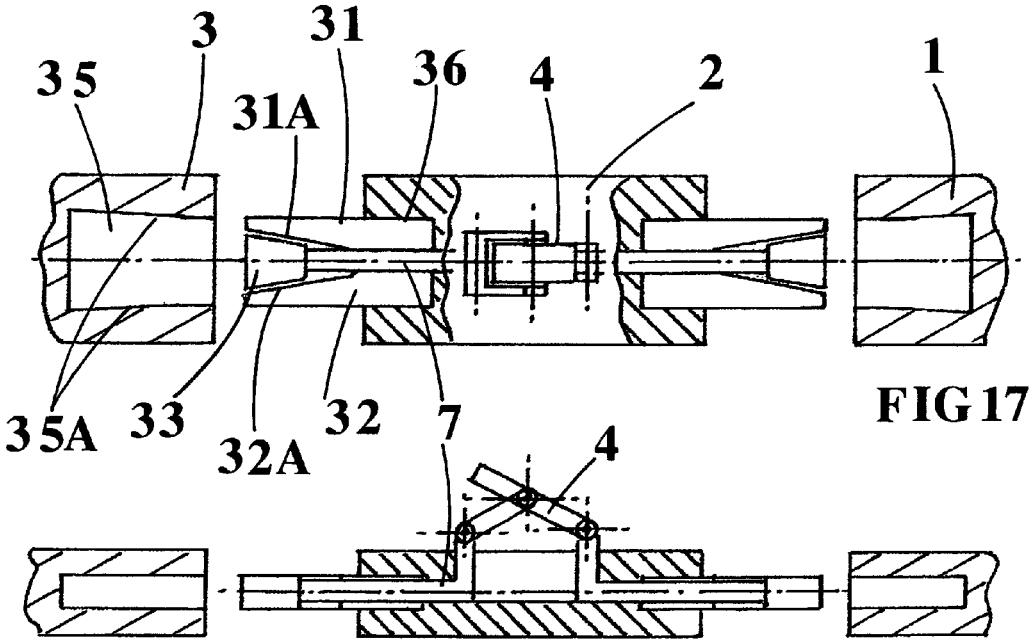
FIG 17
FIG 18
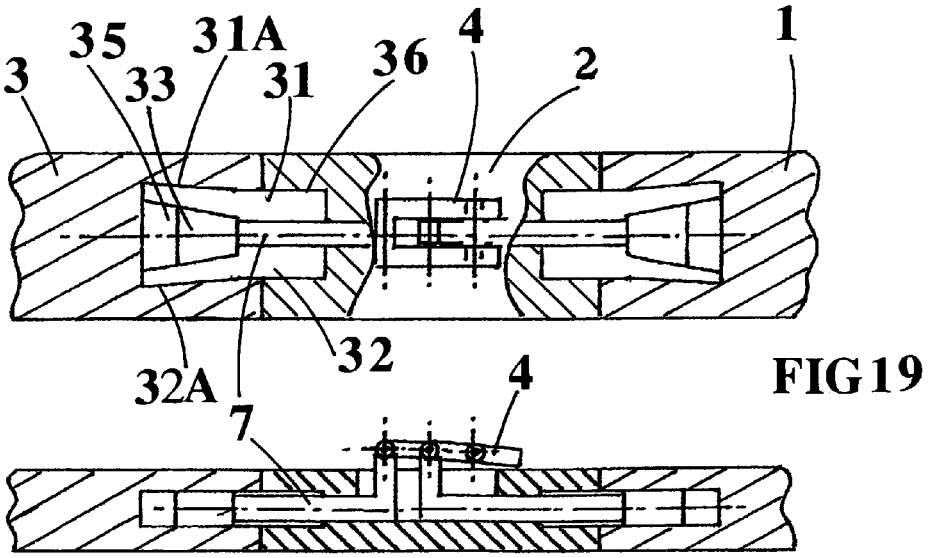
FIG 19
FIG 20

COLLAPSIBLE SKI

THE INVENTION relates to a ski and more particularly to a collapsible ski that disassembles into a package size that can be transported much more conveniently than a one piece ski. For example, a composite ski embodying the present invention having an assembled length of 1650 mm long can be disassemble into a package size of 600 mm long, and therefore, unlike the one piece ski, it is compatible with automated luggage handling systems, particularly at airports and can also be accommodated on the inside of most automobiles.

A problem with known collapsible skis is that the connection interface between the separate ski runners can present a weak point. In use, any undue forces on the composite ski can cause the runners to move apart from one another.

A ski is provided with a binding system, into which the ski boot is attached in use. Conventional ski bindings comprise two anchor points, which respectively contact the toe and heal of a ski boot and act together to clamp the ski boot to the ski.

However, when the ski boot is clamped to the ski, the reaction force supporting the ski boot clamping force translates along the runners and opposes the clamping force urging the runners together thus further weakening the connection interfaces. In some know collapsible skis, particularly those comprising two runners the ski bindings are mounted on a separate base plate positioned on the top face of the runners to prevent the ski boot clamping force from translating to the runners. However, the separate base plate substantially increases the weight and package size of the ski.

A three part runner ski is collapsible into a smaller package than a two part runner ski and therefore preferable over a two part runner ski. However, the construction can present two weak connection interface points. Moreover, assembly is more difficult as the user needs to connect the front and rear runner to the centre runner, and hitherto, a separate locking mechanism has been used for the front and rear runner and positioned respectively at the front and at the rear of the ski bindings.

The present invention seeks to alleviate at least one or more of the above mentioned problems Accordingly, the present invention provides a ski comprising a front runner, a centre runner and a rear runner; the runners connectable together to form a longitudinal running surface, the centre runner further comprising a locking mechanism operable to urge the front and rear runners simultaneously into engagement with the centre runner.

In one embodiment, a front runner, a centre runner and a rear runner; the runners connectable together to form a running surface, the centre runner further comprising a locking mechanism operable to urge the front and rear runners into engagement with the centre runner.

In one embodiment, the locking mechanism is moveable between a closed position, where the front and rear runners are urged into engagement with the centre runner; and an open position to allow assembly and disassembly of the runners.

In one embodiment, the locking mechanism is operated using a control member which when moved to the closed position simultaneously assembles the front and rear runner to the centre runner and when the runners moved to the open position they become disassembled.

In one embodiment, the control member is located in-between the ski bindings.

In one embodiment, the locking mechanism when in the closed position is located flush with, or below, the platforms of the ski bindings which locate the ski boot.

In one embodiment, when the locking mechanism is in the closed position it is situated in-between the outer ski edges of the centre runner.

In one embodiment the force generated when closing the locking mechanism is equally distributed by the linkage mechanism along or through the centre runner directly to the front and rear runner to urge them into engagement with the centre runner and in such a manner there is no force acting directly between the locking mechanism and the centre runner.

In one embodiment, when in use, the ski boot and the ski bindings substantially conceal the locking mechanism so that the ski takes on the appearance of a one-piece ski.

In one embodiment, the control member is a lever forming part of a linkage mechanism to urge the front and rear runners into engagement with the centre runner and configured so that the clamping load is sustained after assembly.

In one embodiment, the control member can be a mechanically operated mechanism that can be positioned in between the ski binders as previously described and having the capability of being operated by a control member to urge the front and rear runners into contact with the centre runner, for example a screw mechanism, a ratchet mechanism, a cam mechanism or a geared rack and pinion or any mechanical device having a similar function.

In one embodiment, the locking mechanism comprises at least one linkage arm, operable to engage with a respective one of the front and rear runner.

In one embodiment, the distal end of the linkage arm comprises one of a male and female connector, and the respective one of the front and rear runner comprises the other of a corresponding female and male connector.

In one embodiment, the male connector and the female connector when engaged together, form a coupled union through which the clamping load is applied to the respective front and rear runner.

In one embodiment, the male and female connector of the linkage arm connecting the front and rear runner to the centre runner are at least partially concealed within the centre runner when the locking mechanism is in the locked position.

In one embodiment, at least one of the connection interfaces between the front runner, centre runner and rear runner comprises a strengthening member, receivable in a recess provided on an adjacent one of the front runner, centre runner and rear runner.

In one embodiment, at least one of the strengthening members comprises at least two parts cooperating together so that when the locking mechanism is closed the movement of the linkage arm which connects to one of the parts produces a movement between at least two parts which causes the strengthening member to increase in size and clamp into the recess in the respective front or rear runner In one embodiment, when the locking mechanism is closed and the strengthening member is increased in size the distal end projecting from the end face of the centre runner is simultaneously made wider than the width at the connection interface of the centre runner and the respective front or rear runner which produces a tapered profile (dovetail) such that as the side faces of the strengthening member are forced against the faces of the recess in the respective front or rear runner the tapered profile urge the runners into engagement with each other.

In one embodiment, the distal ends of the strengthening member projecting from the centre runner is provided with a detent or abutment so that when the strengthening member is assembled into the recess of the relative front or rear runner they engage in a mating detent or abutment to provide a positive connection between the runners.

In one embodiment, the shape of the side faces of the strengthening members and the respective recesses into which they fit have matching oblique side faces forming a dovetail joint which helps restrains the assembly from moving.

In one embodiment, the locking mechanism comprises: two linkage arms arranged about opposing axial end faces of the centre runner and configured to engage with a respective one of the front and rear runner and or the respective strengthening member; a control member connected to each of the linkage arms and configured, in use, to urge the front and rear runners into engagement with the centre runner.

In one embodiment, at least one of the interface surfaces between the front runner, centre runner and rear runner comprises a resilient pad.

The present invention further provides a locking mechanism for a ski, the ski comprising a front runner, a centre runner; and a rear runner, the runners connectable together to form a running surface, the locking mechanism operable to urge the front and rear runners into engagement with the centre runner, in use.

Embodiments of the present invention will now be described, by way of example only, with reference to the accompanying drawings, in which:

FIG. 3 shows a partial sectional side view of the ski in FIGS. 1 and 2;

FIG. 4 is a partial plan cross-sectional view of the ski shown in FIGS. 1, 2 and 3;

FIG. 5 shows a partial cross-sectional side view of the ski, with the locking mechanism between an open and closed position;

FIG. 6 shows a partial cross-sectional plan view of the ski shown in FIG. 5;

FIGS. 17 to 20 show a strengthening member comprising three separate parts embodying the present invention which cooperate together to expand the strengthening member and clamp it into the recess in the respective runner.

As shown in the figures, the ski comprises a front runner 1, a centre runner 2 and rear runner 3 which are held and urged together by a locking mechanism 4 to form a longitudinal and continuous ski running surface.

Figure 1:
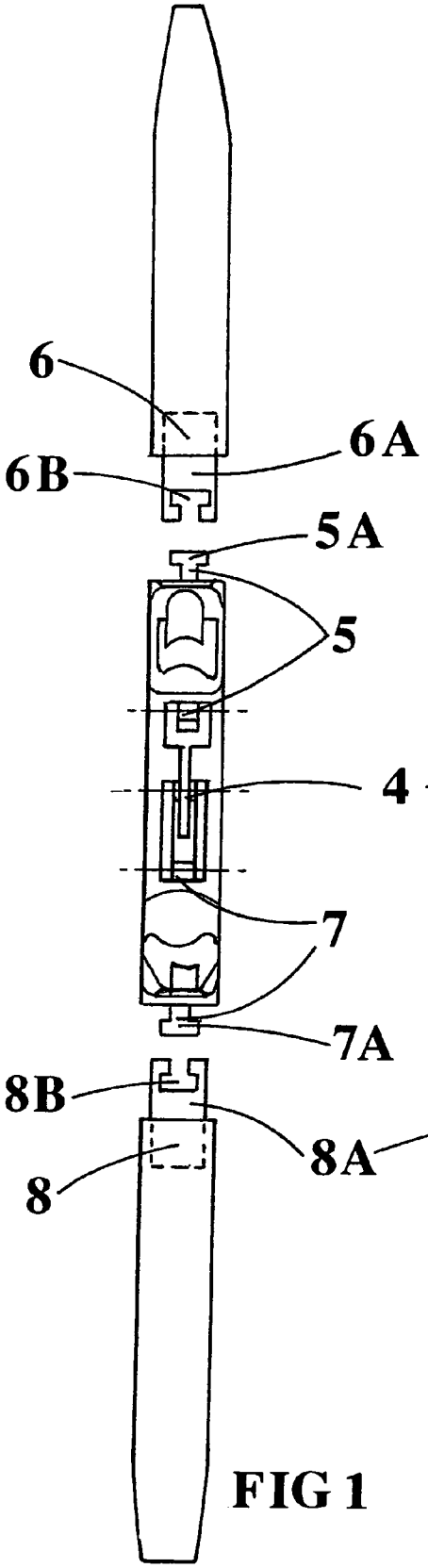
FIG. 1 shows a plan view of a ski embodying the present invention, wherein the front and rear runners are disconnected from the centre runner.
Figure 2:
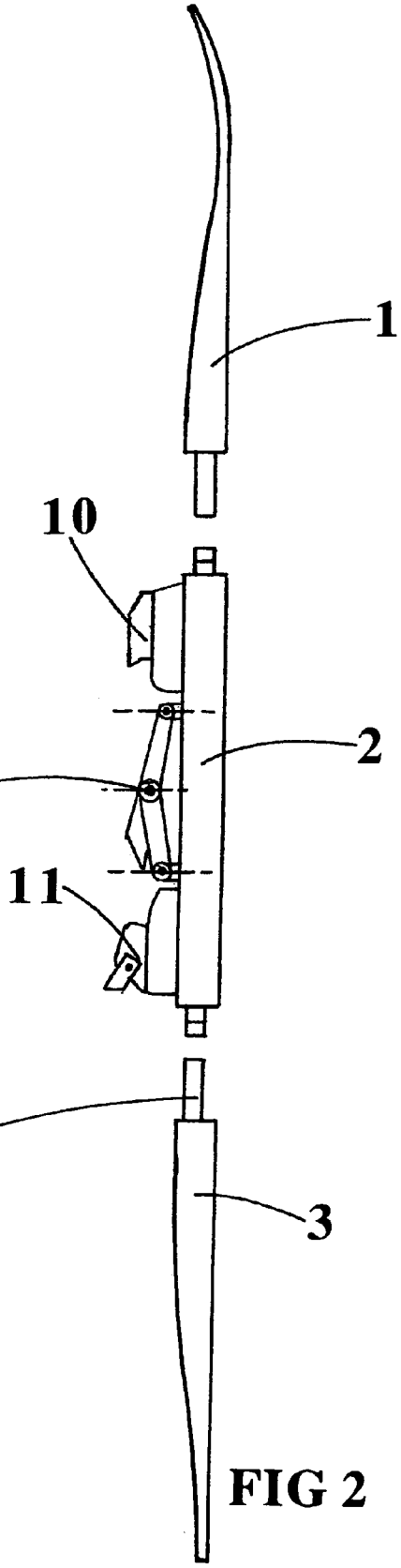
FIG. 2 is a side view of the ski shown in FIG. 1.
Figure 8:
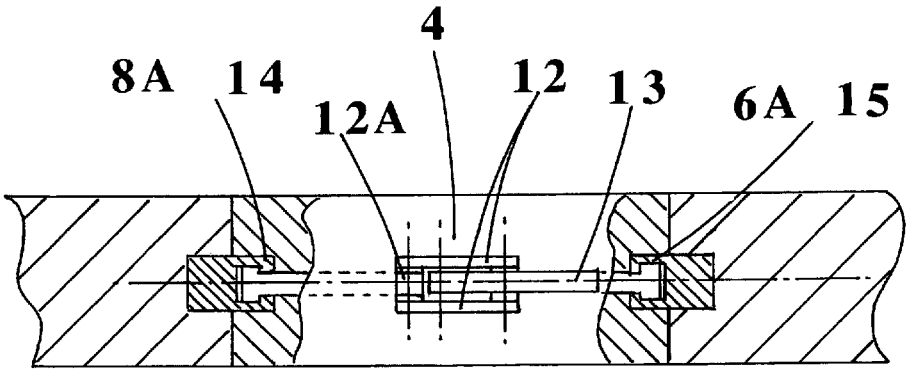
FIG. 8 shows a partial cross-sectional plan view of the ski shown in FIG. 7.

In one embodiment, shown in FIGS. 1 and 2, the locking mechanism 4 is positioned in between the ski bindings 10 and 11 and mounted in and about the upper face of the centre runner. In the locked position shown in FIGS. 7 and 8 the locking mechanism 4 sits below the platforms of the ski bindings 10 and 11 upon which the ski boot is located. Accordingly, in use, the ski boot attached to the ski bindings 10, 11 forms a protective canopy above the locking mechanism 4 and so providing a streamlined and aesthetically pleasing arrangement and in use takes on the appearance of a one piece ski.

The locking mechanism 4 incorporates a front linkage arm 5 and a rear linkage arm 7 so arranged that when the locking mechanism 4 is in the open position they allow the front runner 1 and rear runner 3 respectively to be attached to, or dismantled from, the centre runner 2. When the said front 1 and rear 3 runners are attached to the centre runner 2 and the locking mechanism 4 is moved towards the closed position, the said front 5 and rear 7 linkage arms pull the front 1 and rear 3 runner respectively towards the centre runner 2 until all three runners 1, 2 and 3 form a continuous longitudinal running surface. The final closing movement of the locking mechanism 4 applies a longitudinal clamping load urging and forcing the front runner 1 and rear runner 3 against the centre runner 2 and by so doing keeping the assembled runners 1, 2 and 3 in the correct alignment. Conveniently, the locking mechanism 4 is operated by a single lever 13 which moves and simultaneously urges both the front and rear runners into engagement with the centre runner. As a result, the ski may be assembled with just one action and there is no need to attach the front and rear runners separately.

The ski may further comprise two strengthening members 6 and 8, positioned between the interface surfaces of the front runner 1, centre runner 2 and rear runner 3. The strengthening members 6 and 8 may be positioned on top of, or internally within, the body section of the runners 1, 2 and 3, so that they are concealed when the ski runners 1, 2 and 3 are assembled together.

In the embodiment shown in FIGS. 1 to 8, the front 5 and rear 7 linkage arms of the locking mechanism 4 connect to the strengthening member 6 and 8 of the respective front 1 and rear 3 runners. It will further be noted from FIGS. 1 to 8 that the front 5 and rear 7 linkage arms protrude from a respective recess 14, 15 provided in the interface surface at either end of the centre runner 2. As the strengthening members 6, 8 are received in the recesses 14, and 15, the strengthening members 6 and 8 are keyed into the recesses 14 and 15 so as to provide structural integrity. In one embodiment, the strengthening members may be tapered towards their distal end, with the corresponding recesses being respectively tapered.

The front 5 and rear 7 linkage arms of the locking mechanism 4 which connect to the front 1 and rear 3 runners respectively are positioned so that they pass longitudinally along the body, and/or internally through the body section of the centre runner 2 such that they operate below the platform of the ski binding 10 and 11 upon which the ski boot is located. The benefit of this arrangement is that the linkage arms are protected by the ski body and, moreover, a more aesthetically pleasing ski is provided. Furthermore, by providing the linkage arms within the body of the ski (centre runner), the clamping force offered thereby is acting through the centre of the interconnecting interface, avoiding any moment arms that may otherwise cause the runners to snap apart from one another when clamped (urged) together.

FIGS. 1 to 8 show one embodiment of the present invention which uses a toggle action linkage locking mechanism 4 to move and position the front 5 and rear 7 linkage arms longitudinally and internally through the centre runner 2 in order to attach and clamp the front runner 1 and the rear runner 3 against the centre runner 2.

In one embodiment, shown in FIGS. 1 to 8, the front 5 and rear 7 linkage arms connect to the front 1 and rear 3 runners by a T-shaped mortice 6B and 8B and tenon 5A and 7A joint. The joint may instead comprise a dovetail joint or any other suitable joint. In the embodiment shown, the mortises 6B and 8B are provided on the end of the strengthening members 6 and 8. In another embodiment, they may be separate.

FIGS. 3 to 8 are part sectional drawings through the locking mechanism 4, the front runner 1, centre runner 2 and rear runner 3 and show how the linkage arms 5 and 7 connect to, and pull, the front runner 1 and the rear runner 3 into longitudinal contact with the centre runner 2 and apply a clamping load to keep them together and how the strengthening members 6 and 8 across the interconnecting interface of the runners 1, 2 and 3 are positioned. To simplify the presentations, the ski bindings 10 and 11 have not been shown.

In FIGS. 1 and 2, the front runner 1 and the rear runner 3 are disconnected from the centre runner 2. The locking mechanism 4 is shown in the fully open position and is located in-between the front binding 10 and the rear binding 11. The male T tenon 5A formed at the end of the front linkage arm 5 which moves internally within the centre runner 2 is projecting from the centre runner 2. The front runner 1 can be connected to it by means of the mating female T mortice (tenon slot) 6B formed in the external part 6A of the strengthening member 6 partially embedded within the front runner 1. Similarly, the male T tenon 7A formed at the end of the rear linkage arm 7 is projecting from the other end of the centre runner 2 so that the rear runner 3 can be connected to it by means of the mating female mortice (tenon slot) 8B formed in the external part 8A of the strengthening member 8 partially embedded within the rear runner 3.

FIG. 3 is a partial sectional side view taken through the centre runner 2 and shows the front runner 1 and the rear runner 3 disconnected from the centre runner 2, as shown in FIG. 2. FIG. 4 is the corresponding plan view of FIG. 3.

The locking mechanism 4 comprises a pivot arm 12 connected at one end to the rear linkage arm 7 at the pivot joint 12A and the opposite end connected by the pivot joint 13A to an operating lever 13. The operating lever 13 is connected at one end by the pivot joint 13B to the front linkage arm 5. The pivot arm 12 is connected to a midpoint of the operating lever 13 to bring about a mechanical advantage and to define an over-dead centre lever. The length of the pivot arm 12 and the position where it connects to the operating lever 13 is determined so that when the locking mechanism is in the open position as shown in FIG. 3 and FIG. 4, the front linkage arm 5 and rear linkages arm 7 project beyond the end faces of the centre runner 2 in order that the front runner 1 can be connected to the front linkage arm 5 and rear runner 3 can be connected to the linkage arm 7.

FIG. 5 shows the locking mechanism 4 moved to its midpoint travel position after the front 5 and rear 7 linkage arms have been connected to the front runner 1 and rear runner 3 respectively by engagement of the male T tenons into the female T mortises (tenon slots) and the operating lever 13 has been turned clockwise relative to the position shown in FIG. 3. Further, the external part 8A of the strengthening member 8 has been moved into partial engagement with its mating recess 14 located internally within the body of the centre runner 2. Simultaneously, the external part 6A of the front strengthening member 6 has taken up a similar position within its corresponding, mating recess 15.

FIG. 6 shows that the engagement of the male T tenon 7A with the female T mortice (tenon slot) 8B provides a mechanical connection such that any movement of, or load imposed on, the rear linkage arm 7 is simultaneously transferred to the rear runner 3 via the connector 8. A similar connection exists between the front linkage 5 and the front runner 1.

Figure 7:
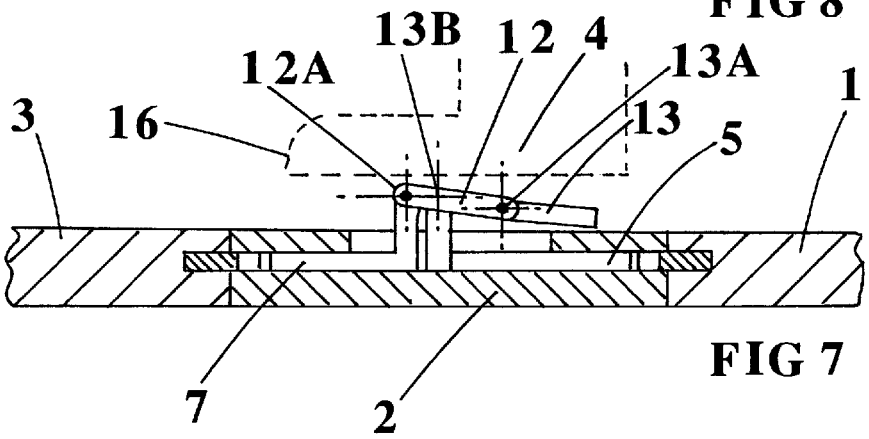
FIG. 7 shows a partial cross-sectional side view of a ski with the locking mechanism in the closed position.

FIG. 7 shows the operating lever 13 of the locking mechanism 4 having moved clockwise relative to the position shown in FIG. 5 shown until the front runner 1 and rear runner 3 make contact with and urged against the centre runner 2. The assembly thus forms a continuous and longitudinal ski running surface. The strengthening members 6A and 8A have fully engaged within the respective mating recesses 14 and 15.

The length of the pivot arm 12 combined with the distance between the pivot joint centre distance between 12A and 13B is determined so that the operation lever 13 must cause the materials of the linkages 5, 7 to stretch (strain) in order to allow the linkages to rotate past the position where the pivot joints 12A, 13B and 13*a* are in alignment. After passing through the aligned position the rotation of the operation lever is arrested so that the said linkage members still retain a stretched position which means there is residual load acting through the locking mechanism to hold and urge the ski assembly together. Also, it can be seen the locking mechanism 4 now sits below the platforms of the ski binding upon which the ski boot is located as represented by the dotted line 16.

In an embodiment, the operating lever 13 is spring loaded, so when the operating lever has moved passed the over centre position into the closed position it is bias to remain in this position after the user has let go of the operating lever.

A particular benefit of the ski embodying the present invention, over the prior art is that the separate parts of the ski are not simply held together by retaining means but are positively urged into engagement with one another and at the same time the strengthening member positioned across the interconnecting faces of the runners provides additional strength. As a consequence, the ski has structural integrity and the joint(s) no longer present(s) such a weak spot, unlike the prior art. As a result, the ski of the present invention may behave more like a conventional ski.

Further, by providing a centre runner, the bindings have a rigid base to attach and be anchored to. There is no need for an additional retaining plate to attach the parts of the ski together.

Figure 9:
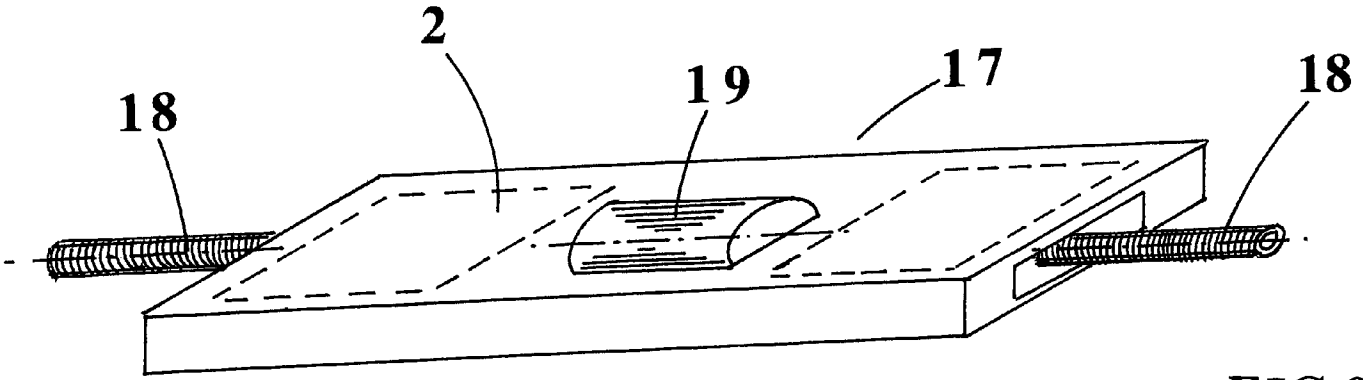
FIG. 9 shows a sketch of a locking mechanism using a screw device to urge the runners into engagement.

FIG. 9 shows another locking mechanism 17 embodying the present invention. In this embodiment, each linkage arm 18 is connectable to the strengthening member which is anchored within the respective front and rear runner. An end of each of the two threaded linkage arms 18 is received in a correspondingly threaded rotary single control member 19 provided in the centre runner. The control member 19 preferably comprises a ribbed outer surface so that it can conveniently be operated by hand (or foot). As the control member 19 is rotated in a predetermined direction, the two linkage arms are caused to move towards one another (into the hub 19). Accordingly, when the front and rear runners are attached to the other respective ends of each of the threaded linkage arms 18, the front and rear runners are caused to engage with and urge against the centre runner of the ski. The means of attachment between the linkage arms and the front and rear runners may be the same as shown in FIGS. 1 to 8. It will be appreciated that the previously shown strengthening member in FIGS. 1 to 8 may also serve as a rotary reaction member to ensure that as the threaded control member is rotated the runners are kept in the correct alignment with each other.

Figure 10:
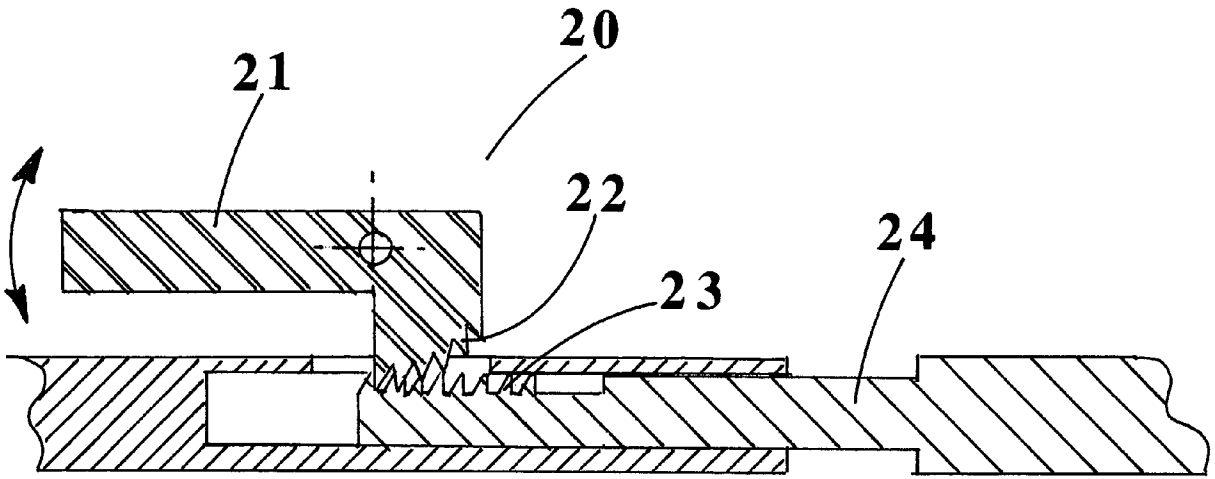
FIG. 10 shows a sketch of a locking mechanism using a ratchet mechanism to urge the runners into engagement.

FIG. 10 shows another locking mechanism 20 embodying the present invention. The locking mechanism comprises a pawl and ratchet or similarly a geared rack and pinion mechanism. To engage one of the front and rear runners with the centre runner, a handle 21 attached to the pawl 22 is rotated (in a clockwise direction in the embodiment shown in FIG. 10) so as to engage with corresponding teeth 23 provided on a tongue 24 of one of the front and rear runners. The handle 21 is rotated back and forth until the front or rear runner (as appropriate) is in engagement with the centre runner. The handle 21 may be on a floating pivot and be spring loaded so as to afford a ratchet operation. In one embodiment a single handle 21 may urge both the front and rear runners into engagement with the centre runner at the same time (with appropriate gearing between the respective pawls).

It will be appreciated that with the embodiments shown in FIGS. 9 and 10, the locking mechanism is positioned in-between the ski binding and configured as set out in the other embodiments described herein.

Figure 11:
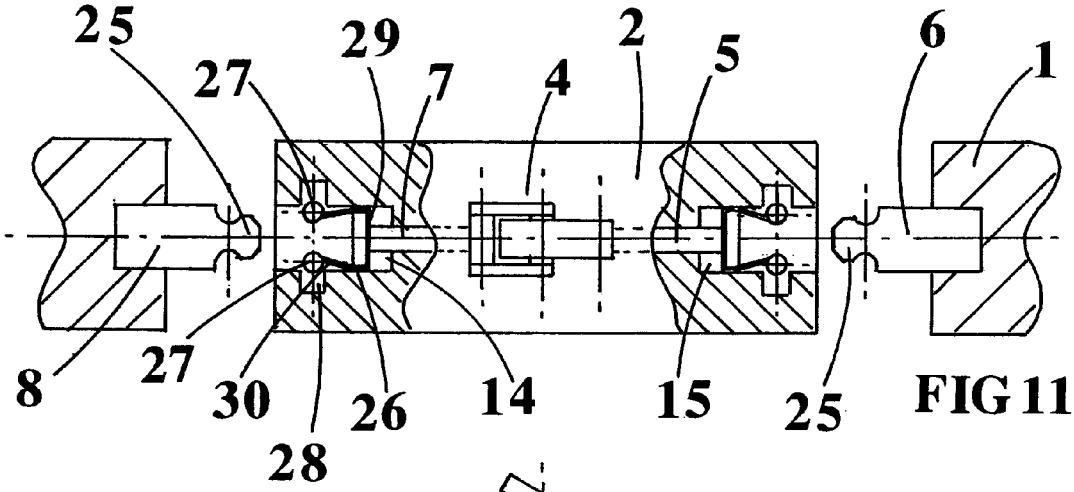
FIG. 11 shows a partial cross-sectional plan view of a ski embodying the present invention with the locking mechanism in an open configuration.
Figure 15:
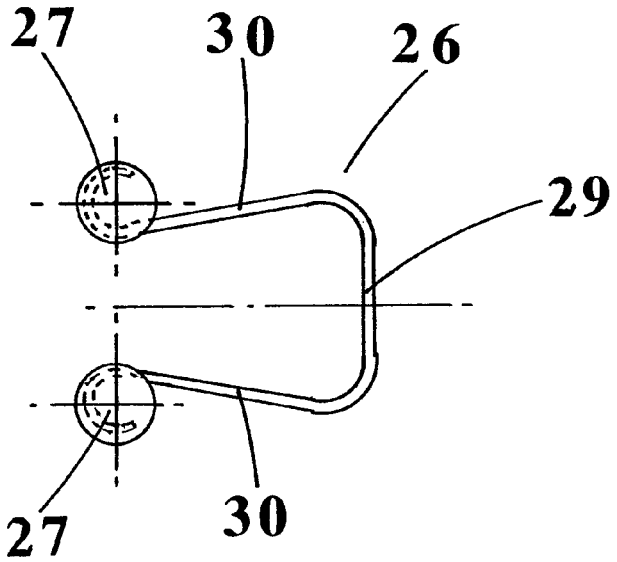
FIG. 15 shows a trapping element embodying the present invention shown in FIGS. 11, 12, 13 and 14.
Figure 16:
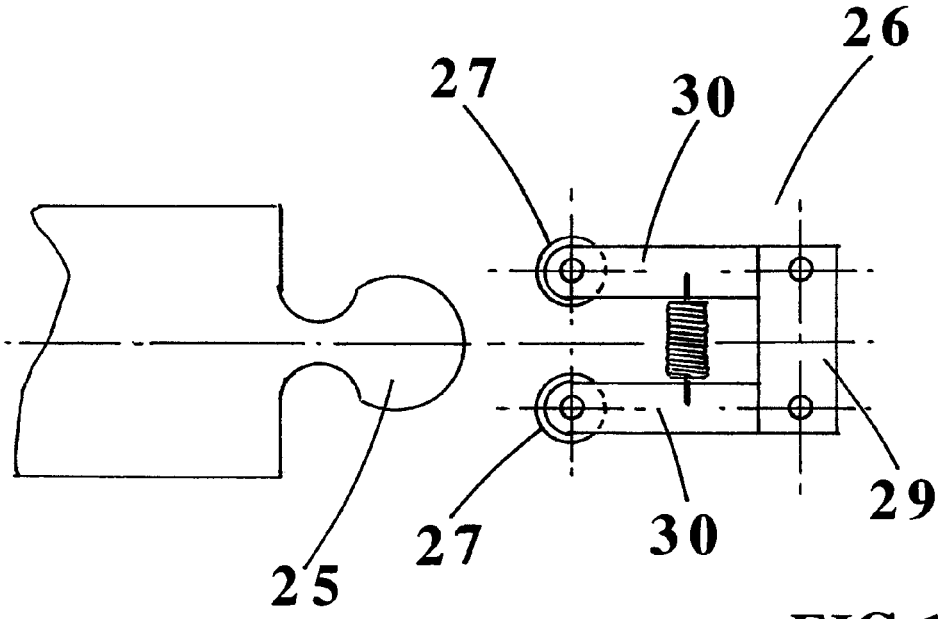
FIG. 16 shows another trapping element embodying the present invention.

FIGS. 11 to 14 show a locking mechanism 4 embodying the present invention having a means of connection between the runners different to those of FIGS. 1 to 8. Specifically, as opposed to using a tenon and mortise joint, the locking mechanism in FIGS. 11 and 12 includes a ball 25 receivable in a trapping element 26. Referring to FIG. 11, the distal end of each of the strengthening members 6, 8, is provided with a ball 25. The ends of the linkage arms 5 and 7 are provided with a trapping element 26. The trapping element 26 comprises a plate 29 which is attachable to the linkage arms 5 and 7. Protruding from the plate 29 are two arms 30, to the end of which are supported in respective rollers 27. The arms 30 are biased into position where the distance between the two rollers 27 is less than the greatest diameter of the ball 25. Two trapping elements 26 embodying the present invention are shown in FIGS. 15 and 16.

Figure 12:
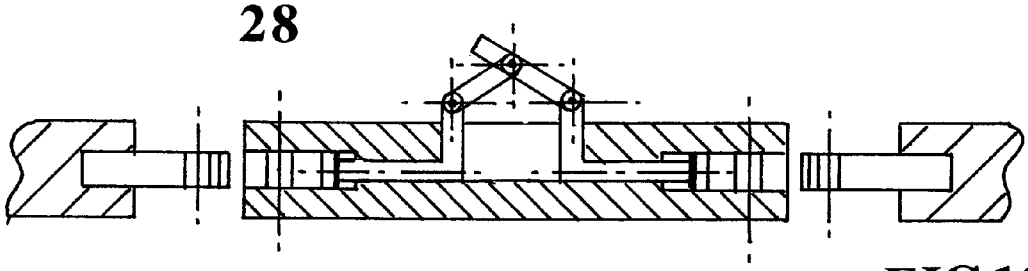
FIG. 12 shows a partial cross-sectional side view of the ski in FIG. 11.
Figure 13:
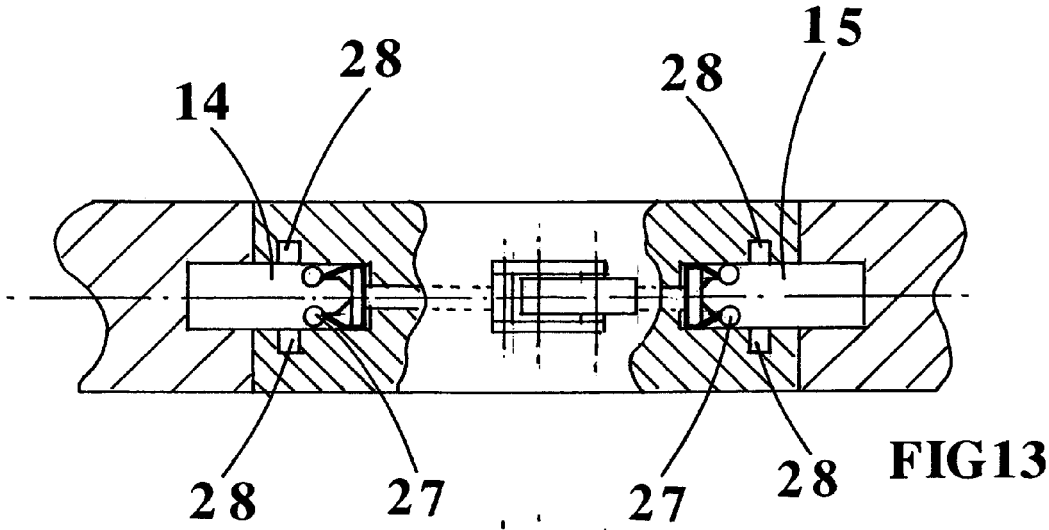
FIG. 13 shows a partial cross-sectional plan view of a ski embodying the present invention with the locking mechanism in a closed configuration.
Figure 14:
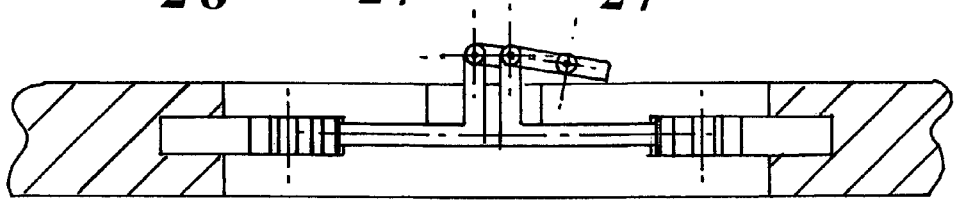
FIG. 14 shows a partial cross-sectional side view of the ski in FIG. 13.

When the locking mechanism 4 of the arrangement shown in FIGS. 11 and 12 is in the open state, the rollers 27 of the trapping element 26 are arranged such that they are immediately adjacent a respective recess 28 provided in the centre runner 2, as shown in FIG. 11. The strengthening member 6 and 8, are inserted into the centre runner 2, so that the balls 25 at the distal ends of the strengthening member 6 and 8 engage with the rollers 27 of each trapping element 26. Further movement of the front and rear runners into the centre runner causes the rollers 27 to move away from one another and for the ball 25 to be accepted into the trapping element 26. It should be noted that as the rollers 27 move away from one another, they are receivable in the recesses 28. After the rollers 27 have moved past the greatest diameter of the ball 25, they engage against a neck portion between the ball 25 and the strengthening member 6 and 8.

The locking mechanism 4 may then be moved into the closed position (FIGS. 13 and 14), which pulls the respective front and rear runners into engagement with the centre runner. It should be noted that, in so doing, the trapping elements 26 have translated within the recesses 14 and 15 to a point where the rollers 27 of the trapping elements 26 may no longer move apart from one another. This is because the rollers 27 are no longer aligned adjacent the recesses 28. Accordingly, the balls 25 at the end of each of the strengthening members 6 and 8 are positively retained in the trapping elements 26. The only way they may be removed is to move the locking mechanism 4 into the open position. Moreover, this arrangement allows for a positive clamping force to be provided to urge the front and rear runners into engagement with the centre runner.

Further, with the arrangement shown in FIGS. 11 and 12, the linkages do not need to travel so far as those shown in FIGS. 1 to 8. It should be noted that the trapping elements 26 do not need to protrude clear of the centre runner but may simply move to a position within the recesses 14,15 where the rollers 27 are adjacent the recesses 28. Accordingly, the size of the lever arrangement of the locking mechanism 4 may be reduced because the linkage arms do not need to travel so far. In an alternative embodiment, the lever arm used with the arrangements of FIGS. 11 and 12 may be the same size as that in FIGS. 1 to 8, and because of the reduced distance travelled by the linkage arms, a greater clamping force may be provided by the greater mechanical advantage offered.

FIGS. 17 to 20 show a locking mechanism 4 embodying the present invention having means of connection between the front runner 1 and the centre runner 2, and the rear runner 3 and the centre runner 2 different to those in FIGS. 1 to 24. Specifically, the strengthening member is comprised of three separate parts 31, 32 and 33. The outer parts 31 and 32 are positioned or fixed into the recess 36 in the centre runner 2 so that a section having internal tapered faces 31A and 32A are projecting from the end face of the centre runner. The inner part 33 has tapered outer faces substantially similar to 31A and 32A and is connected to the linkage arm 7. FIG. 18 and corresponding plan view 17 shows the locking mechanism in the open position with the runners disassembled and linkage arm 7 positioning the inner part 33 so there is radial clearance between the side faces 31A, 32A and in this position the outer parts 31 and 32 can be assembled into recess 35 which has tapered side faces 35A. FIG. 20 and corresponding plan view 19 shows the runners 1, 2 and 3 assembled together with the locking mechanism 4 moved to the closed position causing the linkage arm 7 to move the inner part 33 of the strengthening member into contact with the tapered faces 31A and 32A. The interaction of the tapered faces produces a wedge effect forcing parts 31 and 32 to move apart and clamp into the recess 35. Simultaneously the wedge effect pushes the distal ends of parts 31 an 32 wider apart than the width at the interconnection face between centre runner 2 and runner 3 producing a dovetail profile substantially having the same taper as the tapered side faces 35A and the interaction between the faces urges the runner 3 into contact with runner 2.

A three-part ski according to the present invention may be transported in parts. A ski of the present invention is thus much easier to transport than a conventional single part ski and even a two-part ski and because it can be packaged in a carrying case that is compatible with automatic baggage handling systems and will therefore overcome the hitherto difficulties of transporting a one piece ski especially when flying, using other forms of public transport and inside automobiles.

When used in this specification and claims, the terms "comprises" and "comprising" and variations thereof mean that the specified features, steps or integers are included. The terms are not to be interpreted to exclude the presence of other features, steps or components.

The features disclosed in the foregoing description, or the following claims, or the accompanying drawings, expressed in their specific forms or in terms of a means for performing the disclosed function, or a method or process for attaining the disclosed result, as appropriate, may, separately, or in any combination of such features, be utilised for realising the invention in diverse forms thereof.

The invention claimed is:

1. A ski comprising a front runner (1), a center runner (2), and a rear runner (3); the runners connectable together to form a longitudinal running surface, the center runner further comprises a locking mechanism (4) located in and extending through the top surface of the center runner, operable to urge the front and rear runners into engagement with the center runner, the locking mechanism being moveable between a closed position, in which the front and rear runners are urged into engagement with the center runner, and an open position to allow assembly and disassembly of the runners, characterized in that the locking mechanism comprises a single control member (13) which when moved to the closed position simultaneously urges the front and rear runners into engagement with the center runner and when moved to the open position allows the disassembly of the front and rear runners from the center runner.

2. A ski according to claim 1, wherein the ski includes ski boot bindings (10 and 11), the single control member of the locking mechanism is located in-between the ski boot bindings and in-between two outer edges of the center runner.

3. A ski according to claim 2, wherein the locking mechanism in the closed position is located flush with, or below, platforms of the ski boot bindings (10 and 11) which locate the ski boot.

4. A ski according to, claim 1, wherein the single control member of the locking mechanism is a lever (13) forming part of a linkage mechanism (12, 7, 12A, 13A, and 5) to urge the front runner and rear runners into engagement with the center runner.

5. A ski according to, claim 4, wherein when the locking mechanism is closed the force generated is equally distributed by the linkage mechanism along or through the center runner directly to the front and rear runner to urge them into engagement with the center runner.

6. A ski according to , claim 1, wherein the locking mechanism comprises at least one linkage arm (7), operable to engage with one of the front and rear runner.

7. A ski according to, claim 6, wherein the distal end of the linkage arm comprises one of a male (7A) and female connector, and the respective one of the front and rear runner comprises the other of a corresponding female(8B) and male connector.

8. A ski according to claim 7, wherein the male connector and the female connector when engaged together, form a coupled union through which a clamping load is transferred to the respective front and rear runner urging them into engagement with the center runner.

9. A ski according to claim 7, wherein the male and female connector of the linkage arm (7) are at least partially concealed within the center runner when the locking mechanism is in the locked position.

10. A ski according to, claim 6, wherein at least one of the connection interfaces between the front runner and the center runner and between the center runner and rear runner comprises a strengthening member (8), receivable in a recess (14) provided on the centre runner and providing a load carrying mechanical connection between the respective runners.

11. A ski according to claim 10, wherein at least one of the strengthening members comprises two parts (31, 32) cooperating together and a third part connected to said linkage arm, so that when the locking mechanism is closed the movement of the linkage arm connected to said third part (33) produces relative movement between said two parts which causes the strengthening member to increase in size and clamp into the respective recess in the front or rear runner.

12. A ski according to claim 11, wherein said relative movement between said two parts comprises ends of said two parts distal to an end face of the center runner moving wider apart than the ends of said two parts at the connecting interface of the center runner and the respective front or rear runner thereby producing a tapered profile so that as said two parts move apart in the recess in the respective front or rear runner the tapered profile urges the runners into engagement with each other.

13. A ski according to claim 11 or claim 12, wherein the distal ends of the two parts of the strengthening member projecting from the center runner are provided with a detent or abutment (25) so that when the strengthening member is assembled into the recess of the relative front or rear runner, said detent or abutment engages a mating detent or abutment (26) to provide a positive connection between the runners.

14. A ski according to claim 1, wherein the locking mechanism comprises two linkage arms (5 and 7) arranged about opposing axial end faces of the center runner, each linkage arm configured to engage with a respective one of the front and rear runner said single control member connected to each of the linkage arms.

* * * * *